United States Patent [19]

Frauenknecht et al.

[11] Patent Number: 4,622,045

[45] Date of Patent: Nov. 11, 1986

[54] METHOD OF DYEING WOOL WITH ACID DYESTUFFS

[75] Inventors: Josef Frauenknecht, Therwil; Karl Zeller, Ettingen, both of Switzerland

[73] Assignee: Sandoz Ltd., Basel, Switzerland

[21] Appl. No.: 655,843

[22] Filed: Sep. 28, 1984

[30] Foreign Application Priority Data

Sep. 29, 1983 [DE] Fed. Rep. of Germany ..... 3335342
Aug. 17, 1984 [DE] Fed. Rep. of Germany ..... 3430220

[51] Int. Cl.[4] ..... D06P 1/39; D06P 3/16

[52] U.S. Cl. ..... 8/531; 8/586; 8/602; 8/604; 8/606; 8/638; 8/641; 8/680; 8/683; 8/917

[58] Field of Search ..... 8/531, 602, 680, 606, 8/604

[56] References Cited

U.S. PATENT DOCUMENTS

| | | | |
|---|---|---|---|
| 2,001,975 | 5/1935 | Nocken et al. | 544/338 |
| 2,829,140 | 4/1958 | Schotty et al. | 8/685 |
| 3,658,460 | 4/1972 | Mikula | 8/908 |
| 3,822,113 | 7/1974 | Keenan et al. | 8/551 |
| 4,436,521 | 3/1984 | Annen et al. | 8/493 |
| 4,444,564 | 4/1984 | Salathe et al. | 8/588 |

FOREIGN PATENT DOCUMENTS

| | | |
|---|---|---|
| 446819 | 4/1936 | United Kingdom . |
| 1020499 | 2/1966 | United Kingdom . |
| 1304857 | 1/1973 | United Kingdom . |
| 2120268 | 11/1983 | United Kingdom . |

OTHER PUBLICATIONS

W. Schoenauer et al; Venkataraman's "The Chemistry of Synthetic Dyes", vol. V (Academic Press, 1971), pp. 57 and 63–71.

*Primary Examiner*—A. Lionel Clingman
*Attorney, Agent, or Firm*—Gerald D. Sharkin; Richard E. Vila; Thomas C. Doyle

[57] ABSTRACT

The invention provides a process for dyeing a textile substrate comprising wool fibres, which process comprises bringing the substrate into contact with an aqueous dyebath containing an acid dyestuff or a mixture of acid dyestuffs having (a) a build-up power on wool of from 90 to 98% at pH 4.5; together with (b) a migrating ability on wool of from 25 to 40%, at pH 4.5;

(a) and (b) being determined under specific conditions, in the presence of a levelling agent which is the alkoxylation product of an amine substituted by a fatty saturated or unsaturated residue, the aqueous dyebath containing a mixture of acid dyestuffs when the substrate is a wool/synthetic polyamide fibre blend.

These dyestuffs give level, fast and reproducible dyeings of a high quality.

25 Claims, No Drawings

METHOD OF DYEING WOOL WITH ACID DYESTUFFS

The present invention relates to a process for dyeing a textile substrate comprising wool fibres with acid dyestuffs having specific dyeing properties.

In the dyeing of wool it is known that dyeings having a high level of wet fastnesses are obtained by sacrificing the levelness and vice versa. Among the most widely available wool dyestuffs, the wool dyer has the difficult task to choose between levelling acid dyestuffs which have excellent migrating properties but give dyeings with limited fastnesses, and acid milling dyestuffs and 1:2 metal complex dyestuffs which meet the increased fastness requirements but have a low migrating ability.

A further problem arises in the dyeing of wool/synthetic polyamide fibre blends. It is known that wool and synthetic polyamides have different dye affinities and saturation limits. This difference in dyeing behavior is critical when such blends are dyed in a one bath process. Up to now it has been a real problem to obtain level and on-tone dyeings on such blends under these conditions.

It has now been found that level dyeings with high fastness can be produced on a textile substrate comprising wool fibres by dyeing with acid dyestuffs having a specific build up and migrating behaviour.

Accordingly, the invention provides a process for dyeing a textile substrate comprising wool fibres, which process comprises bringing the substrate into contact with an aqueous dyebath containing an acid dyestuff or a mixture of acid dyestuffs having (a) a build-up power on wool, as herein defined of from 90 to 98% at pH 4.5; together with (b) a migrating ability on wool, as herein defined, of from 25 to 40% at pH 4.5;

in the presence of a levelling agent which is the alkoxylation product of an amine substituted by a $C_{12-30}$ alkyl or alkenyl group or a $C_{13-31}$ alkylcarbonyl or alkenylcarbonyl group; provided that when the substrate is a wool/synthetic polyamide fibre blend, the aqueous dyebath contains a mixture of acid dyestuffs.

The build-up power (a) is assessed under reproducible dyeing conditions as follows:

substrate: wool
goods to liquor ratio: 1:40
pH: 4.5 adjusted with 80% acetic acid
dyeing time: 60 minutes (from the point when the dyeing temperature is reached)
dyeing temperature: 98°±1° C.
dyestuff concentration: as required for a 2/1 standard dyeing depth
evaluation: the % dyebath exhaustion is spectrophotometrically measured during dyeing and colorimetric determination of the exhausted dyebath at the end of dyeing.

The migrating ability (b) of the dyestuffs on wool is assessed by treating a wool sample dyed in a 1/1 standard dyeing depth together with an equal weight of an undyed wool sample in a blind bath under the following conditions:

goods to liquor ratio: 1:40 pH: 4.5 adjusted with 80% acetic acid
treatment time and temperature: 60 minutes at 98°±1° C.
evaluation: the migrating ability is expressed in % as the ratio of the amount of dyestuff on the wool sample which was originally undyed to the amount of dyestuff remaining on the original dyed wool sample. This ratio is assessed from colorimetric measurements.

Preferred acid dyestuffs or dyestuff mixtures for the process of the invention are those having a build-up power (a) of from 94 to 98% or a migrating ability (b) of from 30 to 35%. More particularly preferred are acid dyestuffs or dyestuff mixtures having a build-up power (a) and a migrating ability (b) within these preferred ranges.

By mixtures of acid dyestuffs are to be understood a mixture of acid dyestuffs meeting each the requirements (a) and (b) as well as a mixture of acid dyestuffs containing at least one acid dyestuff whose dyeing properties (a) and/or (b) lie in a range outside that defined above, provided that the resulting mixture behaves as stated above. Preferred mixtures of this latter kind are those obtained from acid dyestuffs having a build-up power (a) close to the range of from 90 to 98%, and/or a migrating ability (b) adjacent to the range of from 25 to 40%. For example, one or more dyestuffs having a migrating ability (b) higher than 40% e.g. up to 45% can be admixed with one or more dyestuffs having a migrating ability (b) within the range of from 40 to 25% or with one or more dyestuffs having a migrating ability (b) smaller than 25% e.g. as low as 7%. The latter type of acid dyestuffs may also be used together with at least one dyestuff having a migrating ability (b) within the range of from 40 to 25%. These various combinations enlarge the shade range possibilities.

The weight ratio of each component in the mixtures of dyestuffs depends on the dyestuff used and is adjusted so that the resulting mixture has a build-up (a) and a migrating behaviour (b) as defined above.

Amongst the above defined acid dyestuffs, those containing a single sulpho group per molecule are particularly preferred.

Examples of suitable acid dyestuffs meeting criteria (a) and (b) are given in Table I.

TABLE I

| dyestuff | (a) % build-up | (b) % migration |
|---|---|---|
| C.I. Acid Red 336 | 96 | 40 |
| C.I. Acid Red 401 | 98 | 29 |
| C.I. Acid Orange 43 | 97 | 31 |
| C.I. Acid Orange 67 | 97.5 | 31 |
| C.I. Acid Green 25 | 98 | 32 |
| C.I. Acid Blue 61 | 95.5 | 32 |
| C.I. Acid Blue 126 | 97.5 | 35 |
| C.I. Acid Blue 142 | 95 | 31 |
| C.I. Acid Blue 230 | 98 | 32 |
| Compound of Example 1 of UK Patent 2,120 268 (blue) | 98 | 30 |
| C.I. Acid Black 50 | 91 | 31 |

Examples of acid dyestuffs not meeting criteria (a) and/or (b), but suitable for combination with each other or with dyestuffs from Table I to give mixtures meeting criteria (a) and (b) are given in Table II.

TABLE II

| dyestuff | (a) % build-up | (b) % migration |
|---|---|---|
| C.I. Acid Red 118 | 95 | 43 |

TABLE II-continued

| dyestuff | (a) % build-up | (b) % migration |
|---|---|---|
| C.I. Acid Red 412 | 99 | 7 |
| C.I. Acid Yellow 61 | 93.5 | 44 |
| C.I. Acid Yellow 127 | 96.5 | 22 |
| C.I. Acid Orange 127 | 99 | 17 |
| C.I. Acid Orange 156 | 93 | 45 |
| C.I. Acid Blue 80 | 98 | 18 |

In addition to their good migrating and exhaustion behaviour, the acid dyestuffs of the invention distinguish by their high wear-fastness level which complies with modern requirements.

A further interesting property of the acid dyestuff range is the optimal combinability of its members, whether as single dyestuffs or as mixtures of selected components. Particularly preferred dyestuff combinations are those for trichromy. These combinations give dyeings with a very high level of reproducibility, particularly e.g. when dyestuffs having close shades are selected for the mixture.

Preferred levelling agents are those described in U.S. Pat. No. 3,658,460, the disclosure of which is incorporated herein by reference. Particularly preferred are compounds of formula I

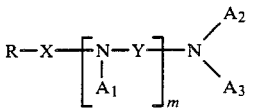

I in which

R is $C_{12-30}$ alkyl or alkenyl

X is a direct bond or —CO—

Y is $C_2$ or $C_3$ alkylene each of $A_1$, $A_2$ and $A_3$ is independently selected from the class consisting of polyethylene oxide chains, the total sum of the ethylene oxide units in all three chains being from 20 to 200, and m is 0 or an integer from 1 to 6, and their quaternization products.

Suitable quaternization agents are, for example, dimethylsulphate, methyl chloride, benzyl chloride etc. Depending on the amount of quaternization agent used, it is possible to quaternize one, several or all of the basic nitrogen atoms.

Preferably R is $C_{16-22}$ alkyl or alkenyl, X is preferably a direct bond, and m is preferably 0, 1 or 2. Preferably the compounds of formula I are not quaternized.

The levelling agent is advantageously added to the dyebath in an amount up to 3% based on the weight of the substrate to be dyed, preferably in an amount of from 0.5 to 2%.

Migration and penetration of the dyestuffs may be further controlled by the addition of sodium sulphate. However, the amount of such an assistant depends on the total electrolyte concentration in the dyebath and is adjusted to avoid too high an electrolyte concentration particularly when the dyebath ratio is short. Suitable amounts of sodium sulphate are from 0 to 20% based on the weight of the substrate to be dyed.

The process of the invention is suitable for dyeing textile substrates consisting of wool or wool blended with synthetic polyamides, polyacrylonitrile, polyester or cellulosic fibres, e.g. cotton. Preferred substrates are wool, particularly carbonized wool, and wool blended with synthetic polyamides or polyacrylonitrile in any available ratio. The substrate may be at any stage of manufacture, e.g. yarn, hand and machine knitting yarn, carpet yarn, knitted, woven, semi-finished or fully fashioned goods or carpets. The process of the invention is also suitable for chlorinated wool.

The wool or wool component of the blends is dyed according to known methods, e.g. by exhaust, preferably at the isoelectric region of wool at a pH value of from 4.5 to 5. Dyeing is advantageously performed at a temperature of from 90° C. to the boil.

Wool/synthetic polyamide fibre blends are dyed using a mixture of acid dyestuffs, particularly a mixture in which at least one of the individual components does not meet criteria (a) and/or (b). The dyeing of such blends is preferably carried out in a one-bath exhaust process. When light or medium shades are desired on this type of blend, it is advantageous to dye in the presence of a reserving agent for polyamides, e.g. a synthetic tannin such as a poly-condensation product based on aromatic sulphonic acids, e.g. a condensation product of dihydroxydiarylsulphones with benzene sulphonic acids (or analogs) and formaldehyde or a compound liberating formaldehyde.

Polyester/wool, cellulose/wool and polyacrylonitrile/wool blends are dyed according to known methods. The acid dyestuffs of the invention are compatible with basic dyestuffs and can be applied within the same pH range as basic dyestuffs.

The goods to liquor ratio may advantageously be within 1:1 and 1:60, preferably from 1:4 to 1:40.

With respect to their dyeing behaviour, the acid dyestuffs of the invention give dyeings having the following properties:

excellent reproducibility of the dyeings and high reliability of the dyeing system which is highly desired for production production of level dyeings having wet fastnesses of a high level for wool and good light fastness excellent root/tip levelness and penetration, particularly when the dyeing is effected in the presence of a levelling agent as defined above very good combinability of the dyestuffs the wool can be dyed in the isoelectric region and with reduced fixation time; therefore the dyeing process is gentle on the fibres and gives wool with a good handle and bulk excellent on-tone partition between wool and synthetic polyamide fibres in polyamide/wool blends; the tinctorial strength can be readily adjusted and dyeings with a high light fastness are achieved on both fibre types good penetration of seams in fully fashioned articles or tightly woven wollen fabrics high wear-fastness even for chlorinated wool; the wet fastnesses of the dyeings on chlorinated wool meet the IWS Specifications for the "Handwash" label wool dyeings, particularly on chlorinated wool, are not impaired by a subsequent antishrink treatment good penetration of carpet yarn even highly worsted and excellent on-tone partition between synthetic polyamides and wool in the case of such blends, production of dyeings having a good fastness to shampoo.

As mentioned, carbonized wool is a particularly preferred substrate to be dyed according to the invention. As a consequence of the carbonizing pre-treatment, the wool to be dyed possesses an acidic pH-value of approximately 2. Carbonized wool is usually dyed with levelling acid or 1:1 metal complex dyestuffs at a pH 1.5 to 2.5. However, although with these dyestuffs at this pH range there are not too many levelling problems, the wool undergoes serious damages at such an acidic pH, e.g. its structure is modified. Although carbonized wool can be partially neutralized before dyeing so that the dyebath has a pH-value of approximately 4, the wool fibres still have a lower pH-value. Under such conditions, dyestuffs with neutral affinity, e.g. milling and 1:2 metal complex dyestuffs do not give level dyeings. However, the acid dyestuffs of the invention produce good dyeing results when applied on carbonized wool, especially partially neutralized carbonized wool, e.g. neutralized with sodium acetate.

The dyestuffs used in the process of the invention are fast, readily combinable and well migrating acid dyestuffs. They give valuable combinations, in particular standard combinations for trichromy based on yellow or orange, red and blue components. A characteristic feature of these combinations is an excellent reproducible on-tone dyeing with good light fastness, also on wool/polyamide blends.

The following examples, in which all parts and percentages are by weight, illustrate the invention. The temperatures are in degrees Centigrade.

EXAMPLE 1

100 Parts wool gabardine are introduced in a dyebath at 50° containing 4000 parts water
10 parts calc. sodium sulphate
1.5 parts of a levelling agent as described in the first paragraph of Example 1 of USP 3 658 460
2 parts of the dyestuff C.I. Acid Blue 126 and adjusted to pH 4.5–5 with 3 parts of 80% acetic acid.

After 15 minutes at 50°, the temperature of the dyebath is raised to 98° over the course of 30–45 minutes and dyeing is run at the boil for a further 30–45 minute period. The water removed by evaporation is continuously replaced. The dyebath is then cooled to 70° over 20 minutes and the substrate is rinsed with warm and cold water and dried in a dryer under mild conditions.

The resulting wool substrate is dyed in a royal blue shade having good light and wet fastnesses.

By repeating the same procedure but replacing the dyestuff C.I. Acid Blue 126 by the following single dyestuffs or mixtures:

| | | |
|---|---|---|
| i | C.I. Acid Red 401 | each in an amount of from 0.2 to 4 parts |
| ii | Example 1 of GB 2 120 268 A | |
| iii | C.I. Acid Blue 61 | |
| iv | C.I. Acid Yellow 61 + C.I. Acid Yellow 127 in a 1:1 ratio | |
| v | C.I. Acid Orange 67 + C.I. Acid Orange 156 in a 9:1 ratio | |
| vi | C.I. Acid Red 412 + C.I. Acid Red 118 + C.I. Acid Red 336 in a 2:1:1 ratio | |

the same good results are obtained.

The dyestuff C.I. Acid Blue 126 can also be replaced in the above described procedure by the following combination for trichromy:

vii 0.5 parts of the mixture v
1.4 parts of the mixture vi and
0.8 parts of C.I. Acid Blue 126 or the dyestuff of -continued Example 1 of GB Patent Specification 2 120 268.

There is obtained a dark brown wool dyeing with excellent tone-in-tone migration.

EXAMPLE 2

One bath dyeing of a 50:50 wool/polyamide fibre blend 100 parts of a 50:50 wool/polyamide fibre substrate is introduced in a dyebath containing 4000 parts water
10 parts calc. sodium sulphate and
2 parts of a commercially available reserving agent based on a polycondensation product of aromatic sulphonic acids (the appropriate amount of this reserving agent depends on the polyamide quality employed).

The dyebath is adjusted to pH 4.5–5 with 2 parts 80% acetic acid and then heated to 50°. After b 15 minutes at 50°, 0.8 parts of the levelling agent of Example 1 and 1 part of the dyestuff C.I. Acid Blue 126 or of the dyestuff of Example 1 of GB 2 120 268 A are added to the dyebath. The temperature of the dyebath is raised to the boil over a period of 45–60 minutes. Dyeing is run for further 30 minutes and then the dyebath is cooled to 70° over 20 minutes. The water eliminated during dyeing by evaporation is continuously replaced. After rinsing and drying, a tone-in-tone blue dyeing with good light and wet fastnesses is obtained.

Instead of C.I. Acid Blue 126 or the dyestuff of Example 1 of GB 2 120 268 A, the dyestuffs or mixtures of dyestuffs 1 (i) to 1 (vii) can be used for dyeing a 50:50 wool/polyamide fibre substrate in one bath.

EXAMPLE 3

One bath dyeing of a 80:20 wool/polyamide fibre substrate

100 Parts of a 80:20 wool/polyamide 66 fibre substrate are introduced in a dyebath containing:

4000 parts water
10 parts calc. sodium sulphate and
6 parts of a commercially available reserving agent based on a polycondensation product of aromatic sulphonic acids and adjusted to pH 5 with 80% acetic acid and 2 parts sodium acetate. The dyebath is heated to 50° and, after a period of 15 minutes at 50°, 1 part of the levelling agent of Example 1, 0.38 parts of a dyestuff mixture containing 43.00 parts of the dyestuff C.I. Acid Orange 156, 57.00 parts of the dyestuff C.I. Acid Orange 127, 0.24 parts of the dyestuff C.I. Acid Red 336 and 0.24 parts of the dyestuff of Example 1 of GB 2 120 268 A are added. The temperature of the dyebath is raised to 98° over a period of 30–45 minutes and dyeing is continued at the boil for a further period of 30 minutes. After cooling to 70° over 20 minutes, the substrate is rinsed and dried.

A tone-in-tone brown dyeing with good light and wet fastnesses is obtained.

The two orange components used in Example 3 are two dyestuffs whose migration and exhaustion behaviour at pH 4.5 lie outside the above defined range. By mixing these two dyestuffs there is obtained a component which fulfils the migrating and exhaustion parameters as stated in the specification.

In dyeing a wool/polyamide fibre blend, a mixture made up of the dyestuff C.I. Acid Orange 127, C.I. Acid Red 336 and the dyestuff of Example 1 of GB 2 120 268A and used together with the dyeing assistants of Example 3, exhibits, a poor combinability. In comparison with the other partners of the mixture, the orange component, i.e. C.I. Acid Orange 127 has a substantially higher build up on the polyamide component. C.I. Acid Orange 127 has a migrating power of 17% and an exhaustion ability of 99% and thus lies outside the above defined values. By mixing C.I. Acid Orange 127 with an orange dyestuff having better migrating properties and a lower neutral build up, which is the case for the dyestuff C.I. Acid Orange 156 (45% migration and 90% build up) the resulting orange mixture exhibits excellent combinability and leads to very good partition between wool and polyamide fibers in blended fibre substrates.

EXAMPLE 4

Dyeing of chlorinated wool ("Handwash" label)

100 Parts of chlorinated wool gabardine (treated with 4% Basolan®, Registered Trade Mark, BASF, Germany) are introduced in a dyebath at 50° containing 4000 parts water
10 parts calc. sodium sulphate
1.00 part of the levelling agent of Example 1
0.48 parts of the dyestuff C.I. Acid Orange 67
0.04 parts of the dyestuff C.I. Acid Orange 156
0.19 parts of the dyestuff C.I. Acid Red 412
0.1 parts of the dyestuff C.I. Acid Red 118
0.09 parts of the dyestuff C.I. Acid Red 336
1.8 parts of the dyestuff of Example 1 of GB 2 120 268 A and adjusted to pH 4.5 with 80% acetic acid.

After 15 minutes at 50°, the dyebath is heated to 98° over the course of 30–45 minutes and maintained at the boil for 30 minutes. The water removed by evaporation is continuously replaced. After cooling to 70° over the course of 20 minutes, the substrate is rinsed first with warm water and then with cold water and then dried under mild conditions in a dryer.

There is obtained a grey dyeing with wet fastnesses meeting the IWS-Specifications and having good light fastnesses.

The resin antishrink treatment for the IWS label "Handwash" wool can also be effected after dyeing.

EXAMPLE 5

Dyeing of carbonized wool

100 Parts carbonized wool fabric are introduced in a dyebath at 40° containing 3000 parts water and 5 parts sodium acetate. After 15 minute treatment, 10 parts calc. sodium sulphate and 2 parts of the levelling agent of Example 1 are then added to the dyebath. After 5 minutes, the following ternary combination is added:

yellow component:
0.045 parts of the dyestuff C.I. Acid Yellow 61, and
0.0045 parts of the dyestuff C.I. Acid Yellow 127
red component:
0.25 parts of the dyestuff C.I. Acid Red 412,
0.14 parts of the dyestuff C.I. Acid Red 118 and
0.12 parts of the dyestuff C.I. Acid Red 336
blue component:
1.3 parts of the dyestuff of Example 1 of GB 2 120 268 A.

After 10 minutes, the dyebath is heated to 98° over the course of 45 minutes and maintained at the boil for further 45 minutes. Thereafter the dyebath is cooled to 70° over a period of 20–30 minutes. The substrate is rinsed with warm and then cold water and dried under mild conditions.

A greyish blue dyeing with good fastnesses and a level penetration is thus obtained. The resulting wool quality is notably improved when compared with wool dyed with 1:1 metal complexes or levelling acid dyestuffs.

What is claimed is:

1. A process for dyeing a textile substrate comprising wool fibers, which process comprises bringing the substrate into contact with an aqueous dyebath containing a monosulfonated acid dyestuff or a mixture of monosulfonated acid dyestuffs, said dyestuff or mixture having (a) a build up power such that it exhausts onto wool to an extent of 90 to 98% in 60 minutes from a dyebath having a temperature of 98±1° C., a pH of 4.5, a goods: liquor ratio of 1:40 and a dyestuff concentration as required for a 2/1 standard dyeing depth, and (b) a migrating ability such that it is capable of migrating to an extent of 25 to 40% in 60 minutes from a wool sample dyed in a 1/1 standard dyeing depth to an initially undyed wool sample of equal weight in a bath having a temperature of 98±1° C., a pH of 4.5 and a goods:liquor ratio of 1:40, said 25 to 40% being the ratio after said 60 minutes, of the amount of dyestuff on the initially undyed sample to the amount of dyestuff remaining on the dyed sample, and a leveling agent which is an alkoxylation product of an amine substituted by a $C_{12-30}$ alkyl or alkenyl group or by a $C_{13-31}$ alkylcarbonyl or alkenylcarbonyl group, provided that when the substrate is a wool/synthetic polyamide fiber blend the aqueous dyebath contains a mixture of monosulfonated acid dyestuffs.

2. A process according to claim 1, in which the acid dyestuff or mixture of acid dyestuffs as a build-up power (a) of from 94 to 98%.

3. A process according to claim 1, in which the acid dyestuff or mixture of acid dyestuffs has a migrating ability (b) of from 30 to 35%.

4. A process according to claim 1, in which the acid dyestuff or mixture of acid dyestuffs has a build-up power (a) of from 94 to 98% and a migrating ability (b) of from 30 to 35%.

5. A process according to claim 1, in which the dyebath contains a mixture of acid dyestuffs in which at least one acid dyestuff has dyeing properties (a) and/or (b) which lie outside the ranges stated in claim 1, the resulting mixture having a build-up power (a) and a migrating ability (b) as indicated in claim 1.

6. A process according to claim 5, in which the acid dyestuff mixture contains one or more acid dyestuffs having a migrating ability (b) higher than 40% together with one or more dyestuffs having a migrating ability (b) of from 25 to 40% or with one or more acid dyestuffs having a migrating ability (b) lower than 25%, or the acid dyestuff mixture contains one or more acid dyestuffs having a migrating ability lower than 25% together with one or more acid dyestuffs having a migrating ability (b) of from 25 to 40%, the resulting mixture having a migrating ability (b) of from 25 to 40%.

7. A process according to claim 1, in which the acid dyestuff mixture is a trichromic mixture.

8. A process according to claim 1 in which the levelling agent is a compound of formula I

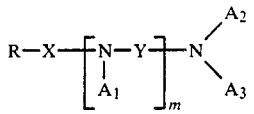

I in which

R is $C_{12-30}$ alkyl or alkenyl,

X is a direct bond or —CO—,

Y is $C_2$ or $C_3$ alkylene, each of $A_1$, $A_2$ and $A_3$ is, independently, a polyethylene oxide chain, the total sum of the ethylene oxide units in all three chains being from 20 to 200, and m is 0 or an integer from 1 to 6, or a quaternization product thereof.

9. A process according to claim 8 in which the levelling agent is a compound of formula I in which R is $C_{16-22}$ alkyl or alkenyl, X is a direct bond, Y is propylene, m is 0, 1 or 2 and the compound is not quaternized.

10. A process according to claim 1 in which the substrate is carbonized wool.

11. A process according to claim 1 in which the substrate is a wool/synthetic polyamide fibre blend, and a mixture of acid dyestuffs is used.

12. A process according to claim 5 in which the substrate is a wool/synthetic polyamide fibre blend.

13. A process according to claim 1 in which the dyeing is carried out by an exhaust process at a pH value corresponding to the isoelectric region of the wool.

14. A process according to claim 8 in which the acid dyestuff or mixture of acid dyestuffs has a build-up power (a) of from 94 to 98% and a migrating ability (b) of from 30 to 35%.

15. A process according to claim 9 in which the acid dyestuff or mixture of acid dyestuffs has a build-up power (a) of from 94 to 98% and a migrating ability (b) of from 30 to 35%.

16. A process according to claim 14 wherein the levelling agent is present in an amount of 0.5 to 2%, by weight, based on the weight of the substrate.

17. A process according to claim 15 wherein the levelling agent is present in an amount of 0.5 to 2%, by weight, based on the weight of the substrate.

18. A process according to claim 15 wherein the dyeing is carried out by an exhaust process at a pH corresponding to the isoelectric region of the wool.

19. A process according to claim 8 wherein the levelling agent is present in an amount of 0.5 to 2%, by weight, based on the weight of the substrate.

20. A process according to claim 8 wherein the acid dyestuff or mixture of acid dyestuffs has a build-up power (a) of from 94 to 98% or a migrating ability (b) of from 30 to 35% and the dyeing is carried out at a pH corresponding to the isoelectric region of the wool.

21. A process according to claim 18 wherein the aqueous dyebath contains a mixture of acid dyestuffs.

22. A process according to claim 18 wherein the substrate is carbonized wool.

23. A process according to claim 19 wherein the dyeing is carried out by an exhaust process at a pH corresponding to the isoelectric region of the wool.

24. A process according to claim 19 wherein the substrate is carbonized wool.

25. A process according to claim 23 wherein the substrate is carbonized wool.

* * * * *